US005293958A

United States Patent [19]

Swiderski et al.

[11] Patent Number: 5,293,958

[45] Date of Patent: Mar. 15, 1994

[54] LADDER STAND-OFF ACCESSORY AND RUNG ADAPTER THEREFOR

[75] Inventors: Paul R. Swiderski, Scott County; Thomas J. Schmitt; David L. Pringle, both of Jefferson County, all of Ky.

[73] Assignee: Emerson Electric Co., St. Louis, Mo.

[21] Appl. No.: 974,809

[22] Filed: Nov. 12, 1992

[51] Int. Cl.[5] ..... E06C 7/48

[52] U.S. Cl. ..... 182/214; 182/107

[58] Field of Search ..... 182/214, 107, 229, 228, 182/231.5, 121, 107

[56] References Cited

U.S. PATENT DOCUMENTS

| | | | |
|---|---|---|---|
| 2,432,189 | 12/1947 | Bucher et al. | 182/214 |
| 3,037,579 | 6/1962 | Barrow | 182/214 X |
| 3,288,249 | 11/1966 | Gibson | 182/214 |
| 3,568,801 | 3/1971 | Werner | 182/214 |
| 3,841,044 | 10/1974 | Brown et al. | 248/345.1 X |
| 4,369,860 | 1/1983 | Beane | 182/214 |
| 4,444,291 | 4/1984 | McPherson | 182/107 X |
| 4,804,063 | 2/1989 | Farris | 182/121 |
| 5,010,979 | 4/1991 | Shreve, III | 182/214 |

FOREIGN PATENT DOCUMENTS

| | | | |
|---|---|---|---|
| 2118236 | 10/1983 | United Kingdom | 182/107 |

*Primary Examiner*—Alvin C. Chin-Shue

*Attorney, Agent, or Firm*—Polster, Lieder, Woodruff & Lucchesi

[57] ABSTRACT

A ladder wall stand-off accessory for mounting on a ladder rung between the spaced side rails of a ladder section including arm stand-off means with wall surface pad means extending therefrom and having rung gripping means pivotally mounted thereon to engage with the ladder rung to be fastened thereto in clamping relation therewith, a novel rung adapter bar being provided to mask the ladder rung if required.

15 Claims, 6 Drawing Sheets

LADDER STAND-OFF ACCESSORY AND RUNG ADAPTER THEREFOR

BACKGROUND OF THE INVENTION

The present invention relates to ladder structure and more particularly to a unique accessory to be mounted on a rung of a ladder between the rung supporting spaced side rails thereof to position the ladder in stand-off position from the wall surface of a construction.

Stand-off accessories utilizing an extension arm fastened at one end to a ladder and having a pad member mounted at the opposite end to rest against a wall surface structure are generally well known in the ladder art. Such an arrangement is disclosed in U.S. Pat. No. 4,754,842, issued to D. L. Southern on Jul. 5, 1988, wherein a pair of extension arms have corresponding ends engaging in the corresponding tops of spaced side rails of a ladder section with spaced pads pivotally mounted at the corresponding opposite ends of the extension arm pair to rest against a wall surface. Attention further is directed to U.S. Pat. Nos. 5,113,973 and 5,121,814, both issued to D. L. Southern on May 19, 1992 and Jun. 16, 1992, respectively, each patent disclosing a lateral or horizontally extending brace of U-shape to include a base section engageably fastened to the spaced side rails and rung therebetween of a ladder section, the spaced arms of the U-shaped brace having their respective side arm ends pivotally support a pair of spaced wall resting pads. Finally, attention is directed to the R. D. Werner Co., Greenville, Pa. 16125 bulletin, disclosing a "TRUE GRIP" ® Model No. 17 stand-off arrangement, which arrangement does not include a lateral or horizontal U-shaped brace but which utilizes a pair of spaced extension arms having spaced rest pads pivotally mounted at one pair of spaced corresponding ends with the opposite ends also engaging both the spaced side rails and the rung therebetween to be fastened to the ladder section for support.

These aforedescribed ladder stand-off accessories have been comparatively complex to manufacture, assemble and maintain, and have presented a limited wall surface contact area. The unique and novel structure of the present invention is straightforward and economical to manufacture, assemble and maintain, requiring a minimum of parts and shipping space, yet assuring stable stand-off accessory support with a maximum of wall surface contact. At the same time, the structure of the present invention, which can be readily adapted to rungs of different cross-sectional configuration, assures proper parts assembly with controlled pad pivoting action and with extended wall surface contact. Further, the present invention provides a unique, readily assembled rung clamping structure, requiring a minimum of clamping parts and, at the same time, assuring a stable, positive and firm connection of the stand-off accessory with rungs of different cross-sectional contour.

Various other features of the present invention will become obvious to one skilled in the art upon reading the disclosure set forth herein.

BRIEF SUMMARY OF THE INVENTION

More particularly, the present invention provides a ladder wall stand-off accessory for mounting on a ladder rung between the spaced ladder side rails comprising: a longitudinally extending arm stand-off means having spaced rung gripping means and wall surface engaging pad means mounted thereon, the rung gripping means being pivotally mounted on the arm stand-off means and being sized and configured to pivotally embrace with a ladder rung between the side rails thereof; and fastening means cooperating with the pivotally mounted rung gripping means and the arm stand-off means to firmly clamp the gripping means with an engaged ladder rung. In addition, the present invention provides a novel rung adapter for a ladder section rung of a first preselected cross-sectional shape to engage and mask the rung to provide a ladder rung contour having a second preselected cross-sectional shape. Further, the present invention provides ladder stand-off structure which assures proper unidirectional assembly, free sliding action of adjacent ladder sections and restricted pivotal movement of wall facing pad surfaces.

It is to be understood that various changes can be made by one skilled in the art in one or more of the several parts of the invention disclosed herein without departing from the scope or spirit of the present invention. For example, instead of the single, longitudinally extending rectangular padded plate disclosed herein, pad structure similar to that previously known in the art could be employed with the inventive arm stand-off and rung gripping structure disclosed. Further, instead of a unitary rung masking device disclosed, it would be possible to mask a rung to a different contour with plate members of different contour with masking occurring only at the area of rung gripping engagement.

BRIEF DESCRIPTION OF THE DRAWINGS

Referring to the drawings which disclosed one advantageous embodiment of the present invention.

DETAILED DESCRIPTION OF THE DRAWINGS

Figure 1:
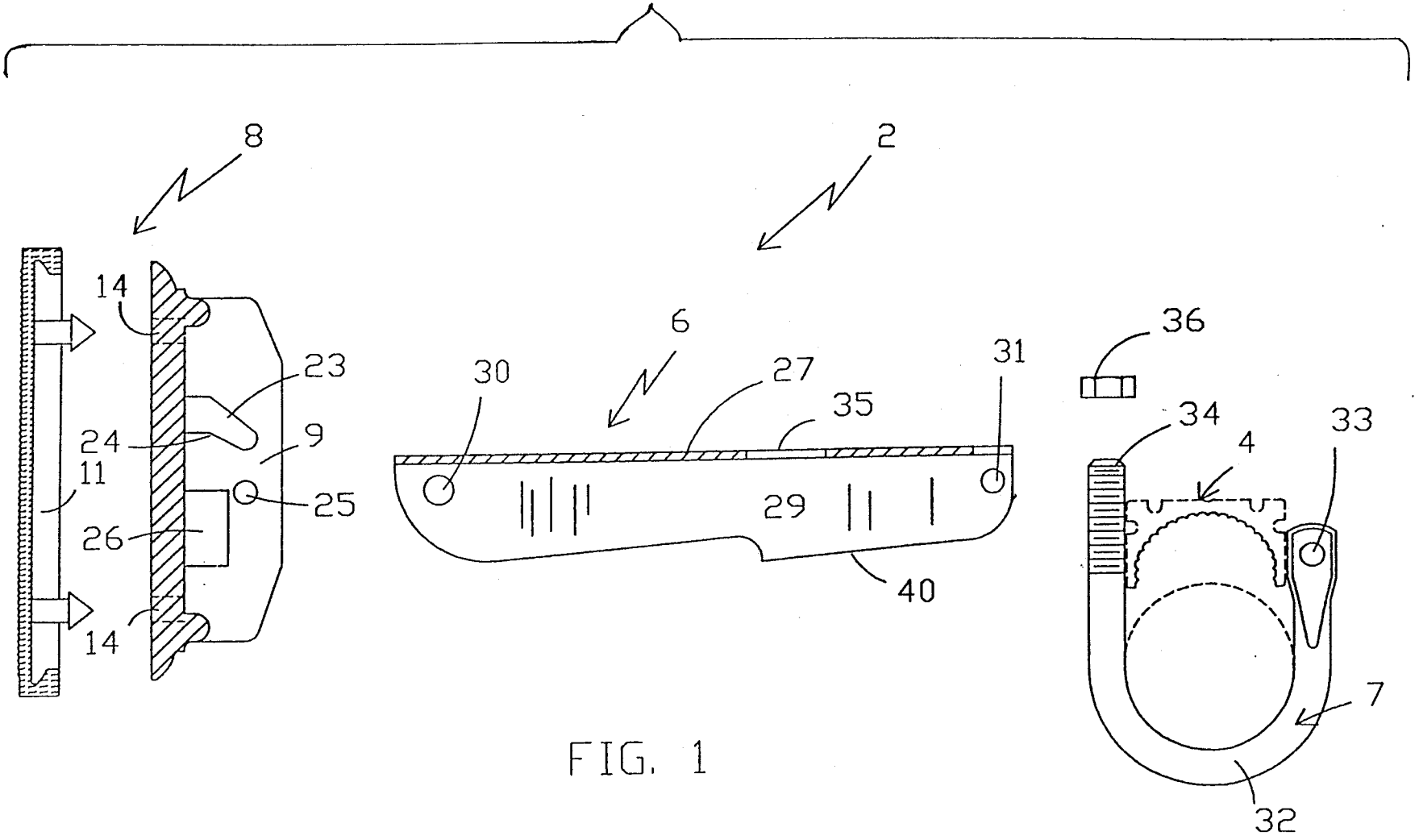
FIG. 1 is an exploded, partially broken away, side view of several of the principal parts of the novel ladder accessory taken through line 1—1 of FIG. 3, a ladder section rung of circular cross-section being shown in phantom with an adapter thereabove to convert the rung to D-cross section.
Figure 2:
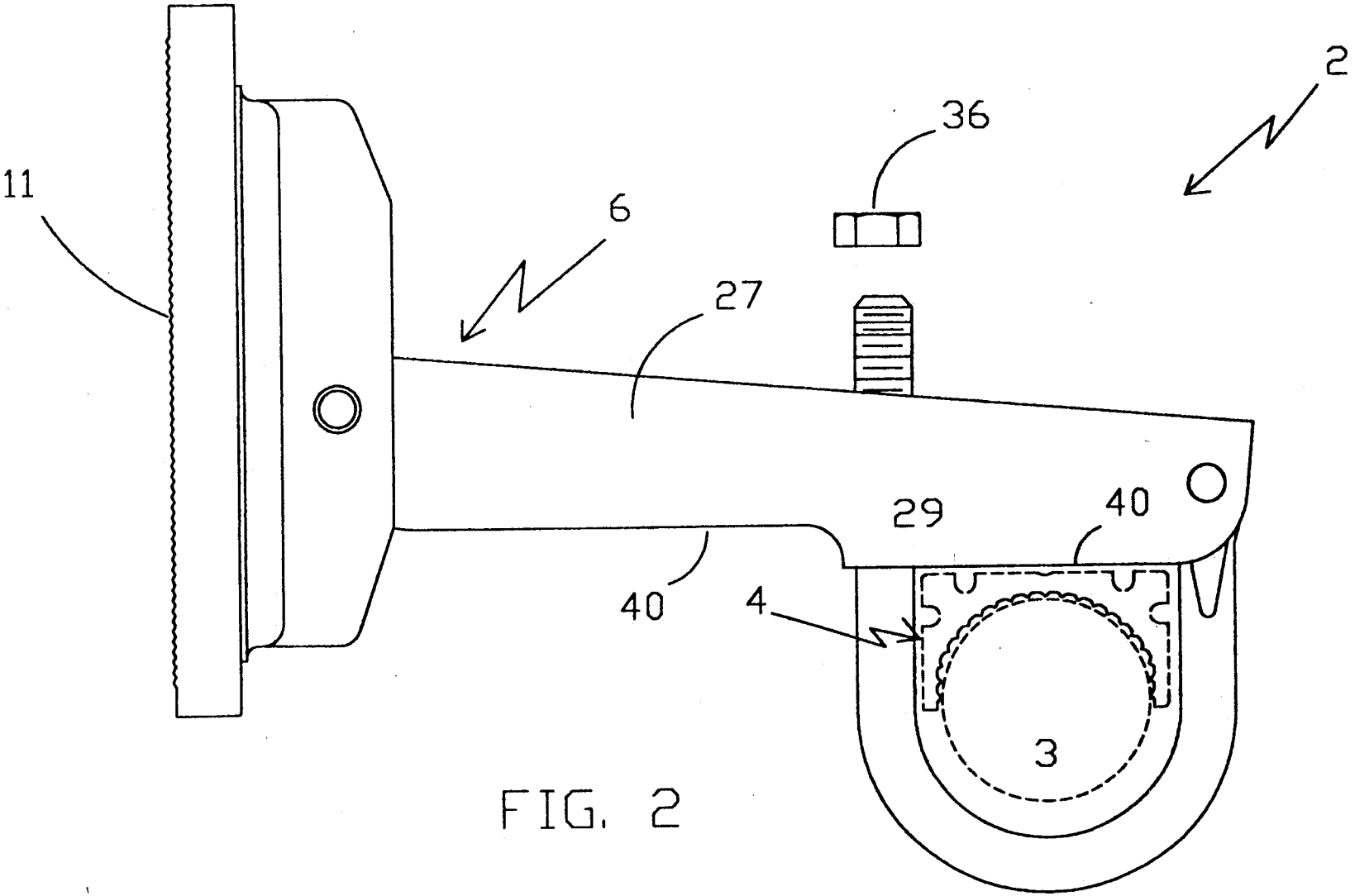
FIG. 2 is an assembled side view of the several parts of FIG. 1 with the phantom rung and adapter shown in slightly spaced relation for illustration purposes.

Referring to FIG. 1 and 2 of the drawings, there is disclosed an exploded side view of a portion of the inventive ladder wall stand-off accessory 2 for mounting on a ladder section rung of circular shaped cross-section 3 (shown in phantom in these two Figures), the stand-off accessory 2 being sized to extend between the spaced ladder side rails of a ladder section (not shown). In this regard, it should be understood that inventive stand-off accessory 2 as disclosed can be manufactured in different sizes and dimensions to meet varying ladder section needs. The major portion of the several parts of the stand-off ladder accessory 2 can be manufactured from any one of a number of known strong, light materials and, advantageously, a suitable metal, such as aluminum can be utilized.

The ladder stand-off accessory 2 as disclosed includes a longitudinally extending rung adapter means in the form of an adapter bar 4 (also shown in phantom in FIGS. 1 and 2), a longitudinally extending arm stand-off means 6 having spaced rung gripping means 7 pivotally mounted at one end thereof to be sized and configured to pivotally embrace with ladder rung 3 and a rung adapter 4 mounted thereon; the arm stand-off means 6 having mounted at the opposite end thereof in pivotal fashion therewith the wall surface engaging pad means 8 which includes a pad supporting plate member 9 and a flexible, removable pad 11 fitted to and supported thereon.

Figure 3:
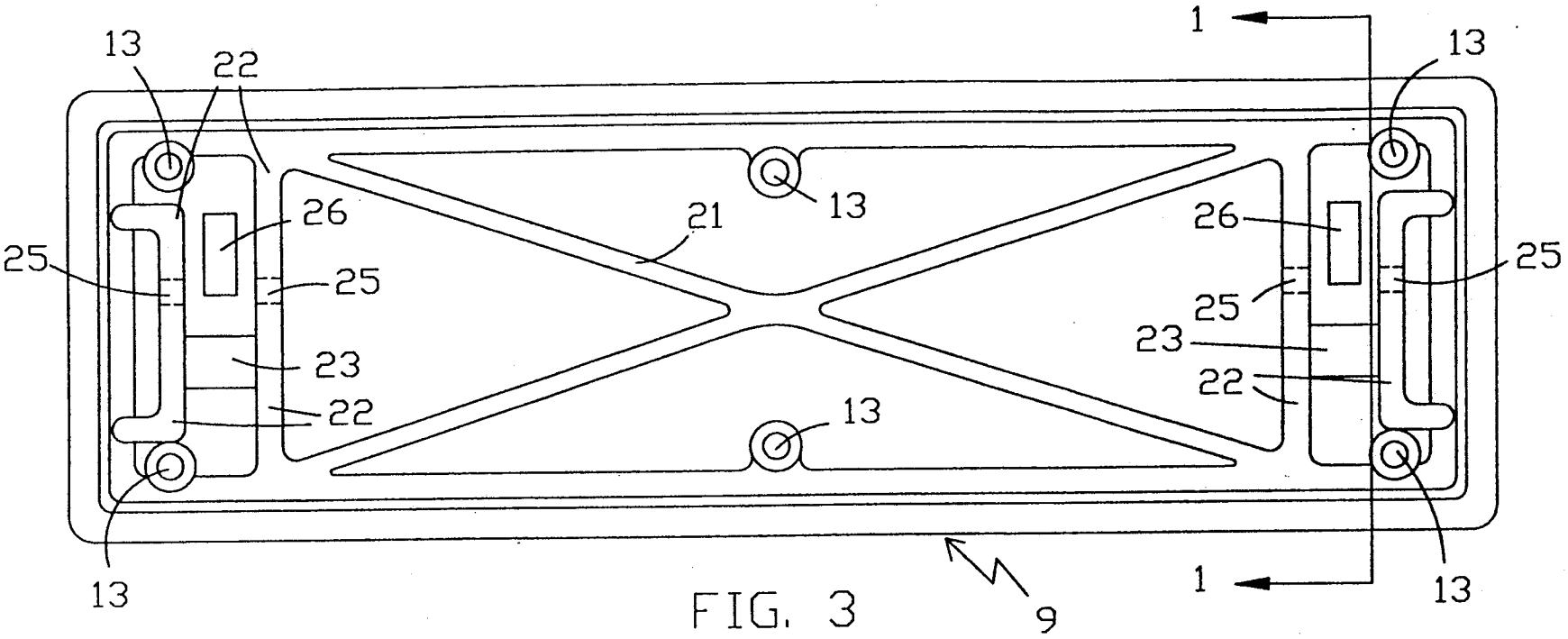
FIG. 3 is an enlarged plan view of that face of the pad supporting, longitudinally extending, rectangular plate member opposite the face receiving the flexible pad member of hereinafter described FIG. 5.
Figure 4:
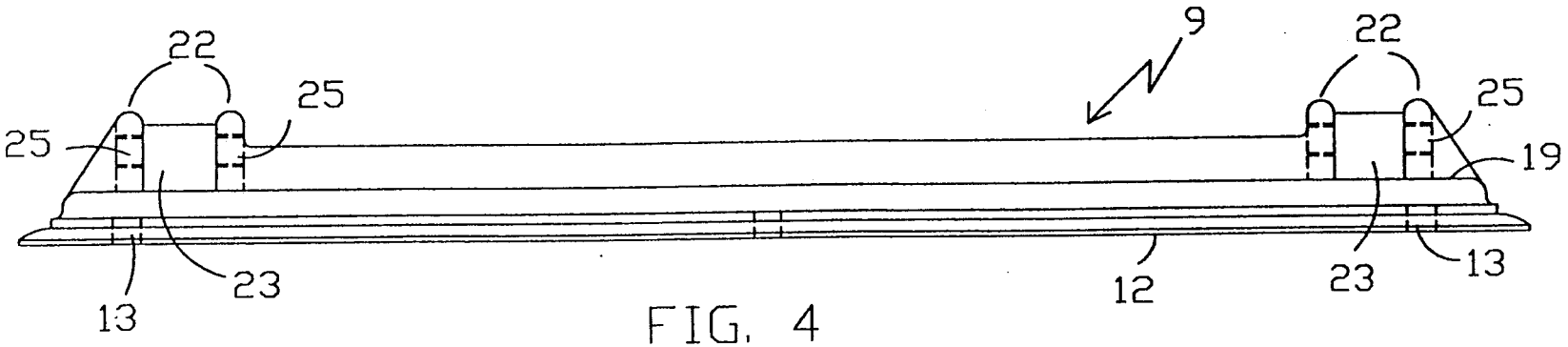
FIG. 4 is a side view of the longitudinally extending plate member of FIG. 4.
Figure 5:
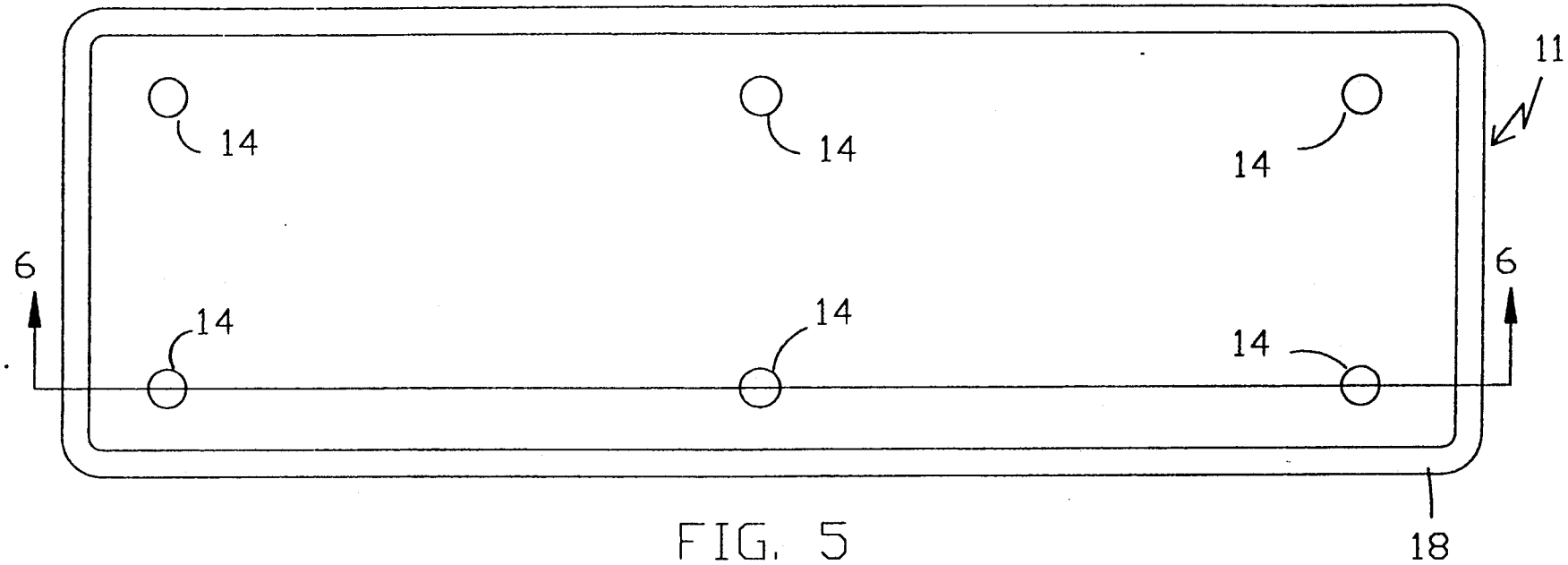
FIG. 5 is a plan view of that face of the pad member which engagingly abuts that face of the plate member of FIG. 3 and 4 opposite the face there disclosed.
Figure 6:
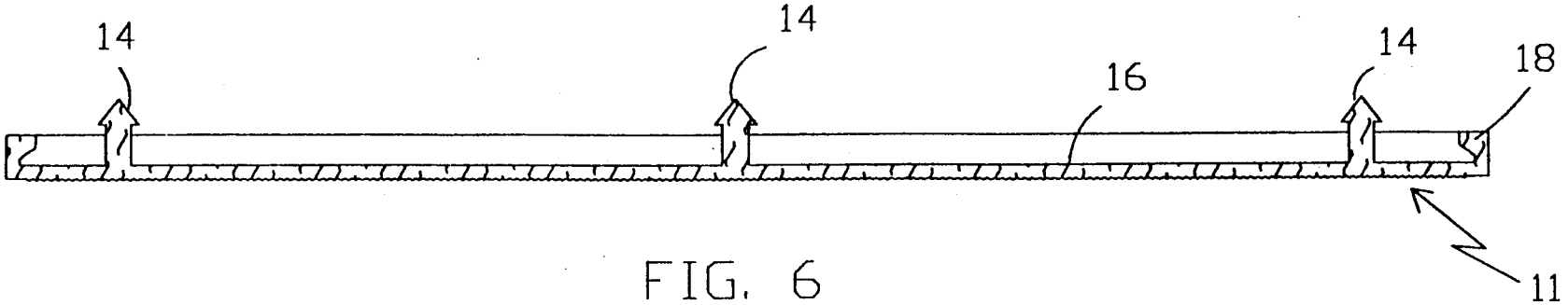
FIG. 6 is a longitudinally extending cross-sectional side view of the pad member of FIG. 5 taken in a plane through lines 6—6 of FIG. 5.

Referring to FIGS. 3 and 4 of the drawing, the pad supporting plate 9 of the wall surface engaging pad means 8 can be seen in more detail. In the embodiment disclosed, plate 9 advantageously is of substantially rectangular shape with its longer dimension extending longitudinally at least substantially a distance equivalent to the distance between the spaced ladder side rails of a ladder section type with which stand-off accessory 2 is to be associated. It is to be understood that other geometric plate configurations could be employed with some plates extending even beyond the distance between spaced ladder rails and, in fact, even two plates rather than the single plate shown could be employed. One face 12 of plate 9 (FIG. 4) can be of flat planar configuration with a plurality of spaced apertures or recesses 13 so as to accommodate dart-like gripping members 14 on the inner face 16 of removable, flexible pad 11, as can be seen in detail in FIGS. 5 and 6 of the drawings. This removable and replaceable substantially rectangular pad 11 (FIGS. 5 and 6) is sized to conform with plate 9 and can be made from any one of a number of known soft, flexible cloth materials—synthetic or otherwise, it being desirable that the other or exterior face of pad 11 can firmly adhere to a wall surface against which it is to rest without any undesirable wall surface defacing. As can be seen in FIG. 6, the exterior face 17 of pad 11 can be serrated or of diamond shape to enhance pad gripping and to reduce the possibilities of stand-off skidding. Pad is provided with an integral lip-like peripheral border 18 which serves to embrace and cover the peripheral edge of plate 9 with dart-like gripping members 14 of pad 11 engaging in male-female relation with the recesses 13 in plate 9.

Figure 7:
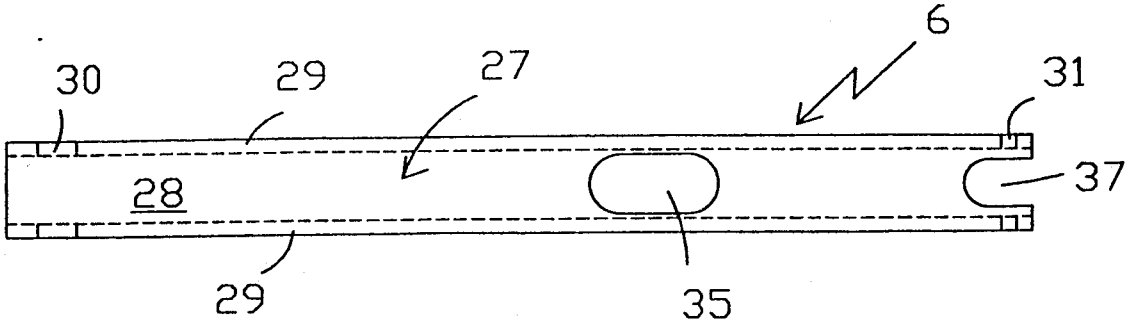
FIG. 7 is a reduced plan view of the base leg of one of the arms of the longitudinally extending stand-off arm members, such as the one disclosed in FIG. 1.

Again, referring to FIGS. 3 and 4 of the drawings, the opposite face 19 of plate 9, that is the face opposite flat planar pad engaging face 12, can be provided with an integral, strength and stability enhancing cross-rib member 21 extending thereacross. In addition, two pairs of spaced, pin receiving oppositely disposed lugs or standard members 22 integrally extend from face 19 of plate 9. Each pair of spaced lug members 22 is provided with opposed pin receiving apertures 25 and each pair of lug members is positioned to extend on plate 9 adjacent and parallel the shorter dimension or side of longitudinally extending rectangular plate 9, further enhancing plate stability. It is to be noted that in accordance with another feature of the present invention, each of lug pairs 22 has an integral pivot limiting block 23 extending therebetween from face 19 of plate 9. Each block 23 is provided with a preselected contour having one edge face 24 (FIG. 1) extending at an angle to the plate face 19 to limit the pivotal angular movement of the plate 9 about the pair of spaced arms of arm stand-off means 6 to which plate 9, is pivotally mounted at corresponding ends of the pair of arms by suitable pins passing through apertures 25 in lug pairs 22 and the mating side legs 29 of the spaced stand-off arm pairs 27 (FIGS. 2 and 7 and 8), as described in detail hereinafter. In this regard, it is to be noted that in addition to pivot limiting blocks 23 positioned between each of standards or lug pairs 22, there are integral positioning blocks 26 extending from face 19 of plate 9, each block 26 being correspondingly disposed between each pair of lugs 22 to insure proper one-way assembly of the pivotal plate 9 to corresponding ends of the pair of spaced arm stand-offs 27 forming the arm stand-off means 6.

Figure 8:
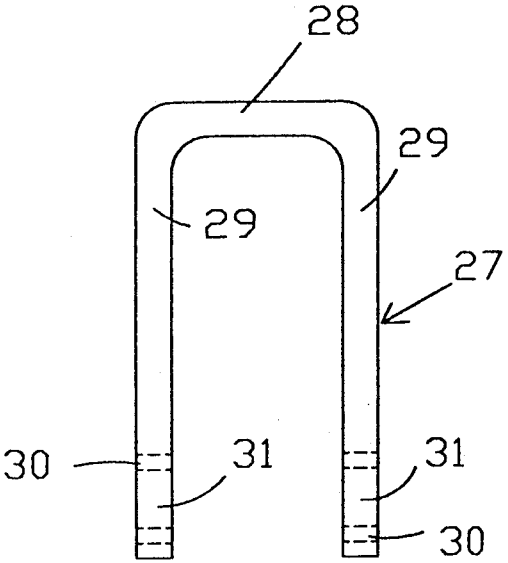
FIG. 8 is an enlarged end view of the arm of FIG. 7.

Referring to FIGS. 1 and 2 and 7 and 8 of the drawings, one such longitudinally extending spaced arm stand-off 27 of a like pair of arm stand-offs can be seen. Each arm stand-off 27 of the pair of longitudinally extending arm stand-offs is of U-shaped cross-section as can be seen in FIG. 8 so as to include a flat base member 28 and spaced side legs 29 extending therefrom with corresponding opposed apertures 30 at one end thereof. As described above, the apertured side legs 29 of each pair of arm stand-off members 27 are positioned between a pair of the spaced apertured lug members 22 on rectangular plate 9 with apertures 30 in side legs 29 aligned with lug apertures 25 to receive a pivot pin so as to pivotally mount rectangular pad carrying plate 9 at one end of the spaced arm stand-offs 27. As aforenoted, longitudinally extending rectangular plate 9 can be mounted in only one position on the arm stand-offs 27 due to the aforedescribed positioning blocks 26 which are integral with plate 9. Further, the pivotal angular movement of plate 9 about the end of arm stand-off members 27 is limited by the aforedescribed edge faces 24 of limiting blocks 23 also integral with plate 9. The spaced arm stand-off members 27 are provided with opposed apertures 31 in side legs 29 at the distal ends thereof opposite the ends on which plate 9 is pivotally mounted. These apertures 31 in the side legs 29 of arm stand-offs 27 serve to pivotally receive a pair of U-shaped swing bolts 32 (FIGS. 1 and 2). Each U-shaped swing bolt 32 is provided at one end with an aperture 33 to be aligned with opposed apertures 31 in opposed side legs 29 at the distal end of arm 27 so as to be pivotally pinned to side legs 29 of arm stand-offs 27. Each U-shaped swing bolt 32 is sized and configured to embrace variable sized ladder section rungs such as rung 3 and rung adapter bar 4 covering ladder rung 3 with the threaded distal end 34 of each bolt passing through a slot 35 in base 28 of each arm stand-off 27 (FIG. 7) to thus receive a nut 36 thereon for tight clamping of the covered rung including rung 3 and adapter bar 4, between the swing bolt 33 and the arm stand-off 27. In this regard, it is to be noted in FIGS. 1 and 2, that the edges 40 of the side legs 29 of each arm stand-off is sized and configured to slope at a preselected angle, advantageously about five degrees, so that the edges and thus each of the arm stand-offs 27 rest at an angle on the flat face of a D-rung or rung adapter 4. This angle rest allows free sliding movement of an adjacent ladder section which might be combined with the ladder section having the stand-off accessory 2 mounted thereon. It further is to be noted in FIG. 7, that the base leg 28 of each arm stand-off 27 is provided with a slot 37 at the aforedescribed distal end of the arm stand-off receiving the swing bolt to accommodate for free movement of the pivotally mounted swing bolt 33.

Figure 9:
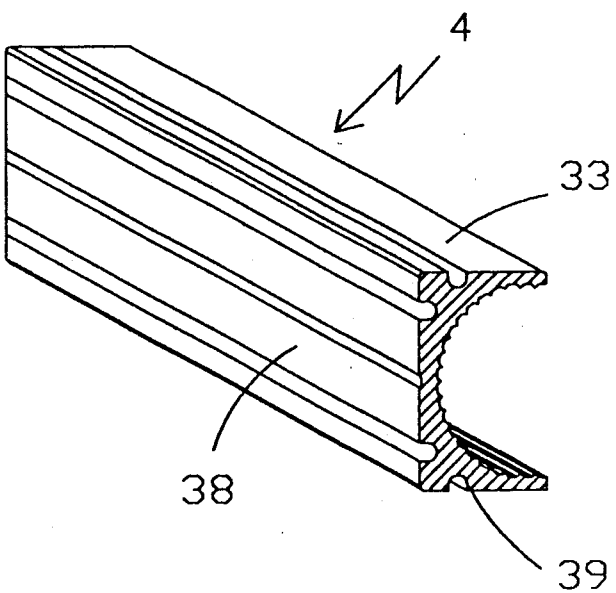
FIG. 9 is an enlarged cross-sectional isometric view of a portion of a rung adapter simulating a flat D-cross-section for arm stand-off engagement with a ladder section rung of circular cross-section as shown in FIG. 1; and, FIG. 10 is an isometric, exploded view of the ladder accessory and adapter to be assembled to a ladder rung.

Finally, referring to FIG. 9 of the drawings which discloses a cross-sectional view of the novel rung adapter bar 4, it can be seen that adapter bar 4 includes a flattened base section 38 which is provided with relief ribs so as to lighten the bar and to enhance surface engagement. Two spaced opposed side leg sections 39 extend from base section 38, the adapter bar 4 being sized and configured to snugly engage a ladder rung 3 of circular shaped cross-section to extend over rung 3 between the spaced side rails of the ladder section supporting rung 3 to convert the rung 3 to a rung of D-shaped cross-section with flat section 38 forming the stepface for rung 3. It is to be understood that it also would be possible, but not necessarily more desirable, to utilize sectional rung adapters, covering rung 3 only in those areas where clamping occurs in order to mount the ladder wall stand-off accessory 2.

Figure 10:
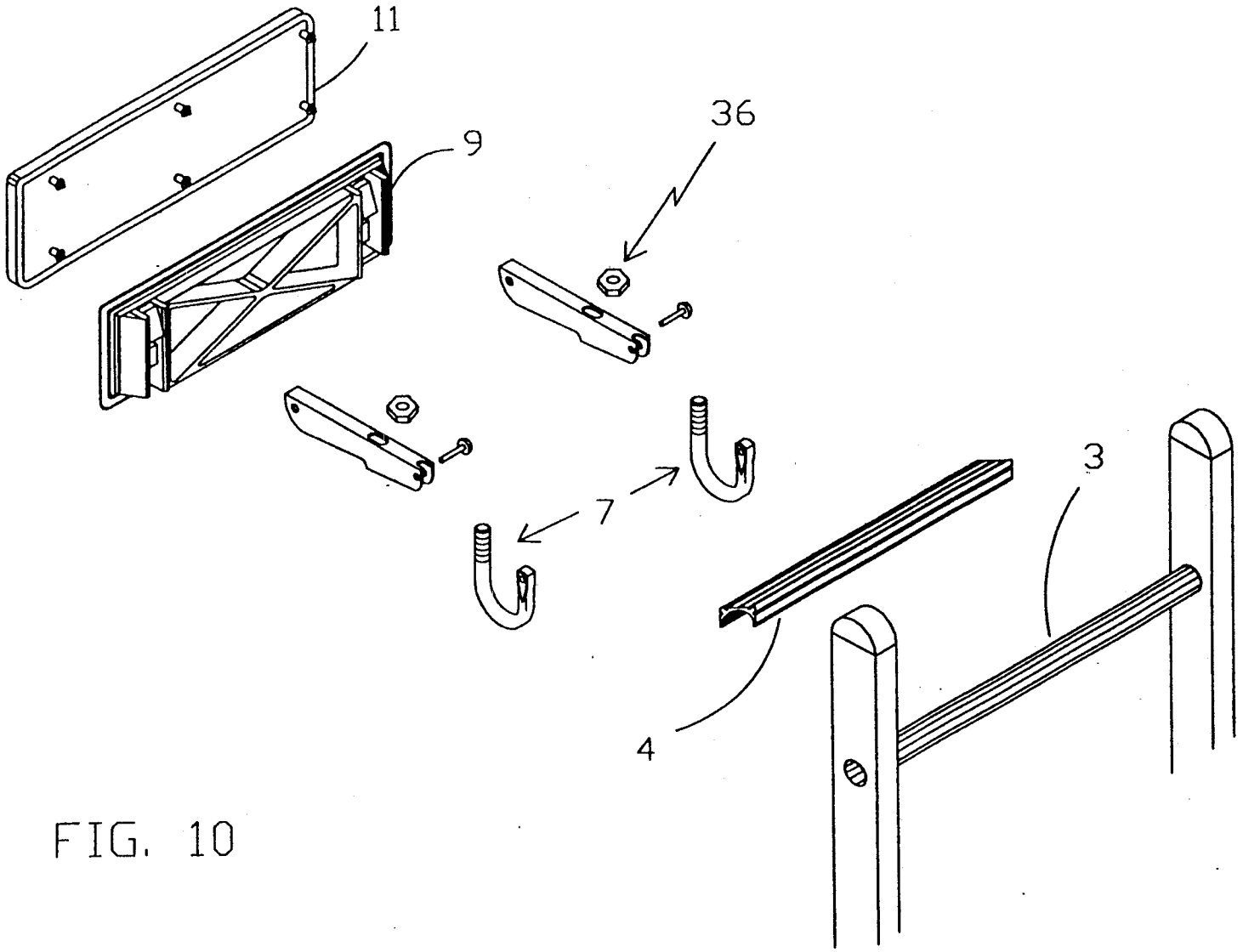

From the above and from FIG. 10 of the drawings, it can be seen that a unique ladder stand-off accessory with a rung adapter therefor is provided for assembly to a ladder rung, the inventive structure being straight-forward and economical to manufacture, assemble and maintain, requiring a minimum of parts and yet providing for stable, stand-off support of a ladder section.

The invention claimed is:

1. A ladder wall stand-off accessory for mounting on a ladder rung of a ladder including spaced ladder side rails, said stand-off accessory being positioned between and independent of said spaced ladder side rails comprising;

a longitudinally extending arm stand-off means having opposite ends with spaced rung gripping and embracing means at one end thereof and wall surface engaging pad means mounted thereon at the opposite end thereof, said rung gripping and embracing means including a pair of U-shaped swing bolts with each of said swing bolts having a free arm section and a pivotal arm section, said pivotal arm section being pivotally mounted on said arm stand-off means with each swing bolt being sized and configured to pivotally engage with and embrace a ladder rung between and independent of the side rails thereof to be in embracing relation with said rung; and, fastening means cooperating with said free arm section of each of said swing bolts and said arm stand-off means to firmly clamp said swing bolts with said engaged and embraced ladder rung.

2. The ladder wall stand-off accessory of claim 1, said pad means being pivotally connected at said opposite end of said arm stand-off means.

3. The ladder wall stand-off accessory of claim 2, and limiting means positioned between said arm stand-off means and said pivotally connected pad means to limit the pivotal angle of movement of said pad means.

4. The ladder wall stand-off accessory of claim 3, said limiting means being fixed to said pad means.

5. The ladder wall stand-off accessory of claim 2 and positioning and limiting means between said arm stand-off means and said pivotally connected pad means to restrict the assembly of said pad means to said arm stand-off means to a preselected position.

6. The ladder wall stand-off accessory of claim 5, said positioning and limiting means being fixed to said pad means.

7. The ladder wall stand-off accessory of claim 1, wherein said U-shaped swing bolts, each has said free arm section threaded at its free end threaded to receive a fastening nut thereon.

8. The ladder wall stand-off accessory of claim 1, wherein said ladder includes at least two adjacent ladders with said arm stand-off means being adapted to firmly clamp said gripping means with an engaged ladder rung of one ladder section to allow sliding clearance of an adjacent ladder section.

9. The ladder wall stand-off accessory of claim 8, said arm stand-off means being contoured to rest at a preselected angle against the ladder rung with which it engages.

10. The ladder wall stand-off accessory of claim 1, said wall surface engaging pad means, including a reinforced support plate longitudinally extending at least substantially the distance between said spaced ladder side rails and including a contoured pad receiving face thereon to snugly receive a removable flexible pad thereover.

11. The ladder wall stand-off accessory of claim 10, said contoured plate having a plurality of spaced female recesses on said face to receive correspondingly spaced grip members mounted on said removable pad.

12. The ladder wall stand-off accessory of claim 10, the free end of said arm stand-off means and that face of said support plate opposite said pad receiving face including a plurality of apertured spaced mating lugs extending therefrom for pivotal mounting of said support plate thereto.

13. The ladder wall stand-off accessory of claim 1, and a rung adapter comprising a longitudinally extending plate member of U-shaped cross-section sized and contoured to snugly engage said ladder rung to provide a ladder rung contour configured to receive said ladder stand-off accessory of claim 1.

14. The ladder wall stand-off accessory of claim 13, said arm stand-off means being configured to rest on the flattened face of a ladder rung of D-shaped cross-section and said rung adapter being shaped to contour a rung of different cross-section to one of D-shaped cross-section.

15. A ladder wall stand-off accessory for mounting on a ladder section rung of circular shaped cross-section between the spaced ladder side rails of a ladder section comprising:

a rung adapter bar of U-shaped cross-section including a flattened base section and two spaced side leg sections sized and configured to snugly engage said ladder rung of circular shaped cross-section to extend over said rung between said spaced side rails to convert said rung to a rung of D-shaped cross-section with said flattened base section forming the step face of said rung;

a stand-off accessory for said converted rung including a rectangular plate member longitudinally extending at least substantially the distance between said spaced ladder side rails, one face of said plate being of flat planar configuration with a plurality of spaced recess female apertures therein to receive the gripping members of a removable pad to be mounted thereon;

a removable, soft flexible longitudinally extending pad with a serrated external gripping face and a lip-like border extending along the perimeter thereof and a plurality of spaced male gripping darts extending from one face thereof, said pad being sized and configured to extend over the face of said plate with the gripping border gripping the side edges of said plate and the male darts engaging said recess female apertures of said plate to provide a covering surface for said plate, the opposite face of said plate having an integral reinforcing cross-rib extending longitudinally thereacross and including two pairs of spaced pin receiving oppositely apertured lug members integrally extending therefrom with each pair of spaced lug members being positioned adjacent the shorter side of said longitudinally extending plate and with each spaced lug member pair having an integral limiting block extending therebetween with a preselected contour having the plane of one edge face thereof extending at an angle to the plate face to limit the pivotal angular movement of said plate and pad mounted thereon and a spaced integral positioning block to restrict the assembly of said plate in one position;

a pair of longitudinally extending U-shaped arm stand-offs each having a cross-section including a flat base member and spaced side legs extending therefrom with corresponding opposed apertures at one end thereof, the apertured side legs of each pair of arm stand-offs being positioned between a pair of spaced apertured lug members on said rectangular plate with the apertures aligned to receive a pivot pin for pivotally mounting said rectangular plate, said rectangular plate being pivotally mountable to said arm stand-offs in only one position due to said position blocks integral with said plate and with the pivotal angular movement of said plate being limited by said edge faces of said limiting blocks integral with said plate, said opposed side legs of each arm stand-off being apertured at the distal end opposite said pivot plate end and having a recess in the flat base portion intermediate said opposite ends; a U-shaped swing bolt for each corresponding distal end of said arm stand-offs, each swing bolt being aperture to be pivotally mounted with a pin passing through the distal side legs of said arm stand-off, said U-shaped swing bolt being sized and configured to embrace said rung adapter covering said ladder rung with the distal end of each of said bolts passing through said recess in said flat base portion of each of said arm stand-offs to receive a nut thereon for tight clamping of said covered rung between said bolt and said arm stand-off, the edges of said opposed side legs of each arm stand-off arm being sized and configured to rest at an angle on the flat face of said rung adapter to allow free sliding movement of an adjacent ladder section which might be combined therewith.

* * * * *